US008957782B2

(12) United States Patent
Yu et al.

(10) Patent No.: US 8,957,782 B2
(45) Date of Patent: Feb. 17, 2015

(54) SYSTEM AND METHOD FOR WARNING A FIRE AND FLAMMABLE GAS

(75) Inventors: Lezhong Yu, Tianjin (CN); Jun Niu, Tianjin (CN); Hongyun Sun, Tianjin (CN)

(73) Assignee: Tianjin Puhai New Technology Co., Ltd., Tianjin (CN)

( * ) Notice: Subject to any disclaimer, the term of this patent is extended or adjusted under 35 U.S.C. 154(b) by 201 days.

(21) Appl. No.: 13/508,808

(22) PCT Filed: Jun. 21, 2010

(86) PCT No.: PCT/CN2010/000900

§ 371 (c)(1), (2), (4) Date: Aug. 8, 2012

(87) PCT Pub. No.: WO2011/057465

PCT Pub. Date: May 19, 2011

(65) Prior Publication Data

US 2012/0293334 A1 Nov. 22, 2012

(30) Foreign Application Priority Data

Nov. 10, 2009 (CN) ..... 2009 1 0237391

(51) Int. Cl.
*G08B 17/10* (2006.01)
*G08B 21/16* (2006.01)
(Continued)

(52) U.S. Cl.
CPC ..... *G08B 17/10* (2013.01); *G08B 21/16* (2013.01); *G08B 29/26* (2013.01); *G08B 17/00* (2013.01)
USPC ..... 340/632; 340/506; 340/577; 340/628; 340/584

(58) Field of Classification Search
CPC ..... G08B 17/00; G08B 21/0423; G08B 21/0446; G08B 21/0433; G08B 21/0461; G08B 25/009; G07C 5/008; G07C 5/0808; B60C 23/0433; B60N 2/002; B60N 2/0232
USPC ..... 340/632, 506, 628, 521, 539.22, 584, 340/540, 577
See application file for complete search history.

(56) References Cited

U.S. PATENT DOCUMENTS 5,148,148 A * 9/1992 Shima et al. ..... 340/539.17
5,376,924 A 12/1994 Kubo et al.
6,624,750 B1 * 9/2003 Marman et al. ..... 340/506
(Continued)

FOREIGN PATENT DOCUMENTS

CN 1239795 12/1999
CN 101251942 8/2008
(Continued)

*Primary Examiner* — Hoi Lau
(74) *Attorney, Agent, or Firm* — Cesari and McKenna, LLP

(57) ABSTRACT

A fire and flammable gas system comprises a signal detector installed in a detection area for detecting flue gas, temperature or flammable gas signal; an alarm controller for real time collecting flue gas, temperature or flammable gas signal detected by the signal detector; a data manager for recording and storing an initial background value of the detector and detection data of the detector during running process, and analyzing the historical data of the detector during running process in real time so as to carry out early-warning in advance or detector self-diagnosis or alarm threshold adjusting; and an early-warning monitor for displaying early-warning analysis result output by the data manager on the monitor. A fire and flammable gas method is also provided.

13 Claims, 8 Drawing Sheets

(51) Int. Cl.
*G08B 29/26* (2006.01)
*G08B 17/00* (2006.01)

(56) References Cited

U.S. PATENT DOCUMENTS

| | | | | |
|---|---|---|---|---|
| 2003/0058093 | A1* | 3/2003 | Dohi et al. | 340/506 |
| 2004/0075566 | A1* | 4/2004 | Stepanik et al. | 340/632 |
| 2006/0176167 | A1* | 8/2006 | Dohrmann | 340/506 |
| 2006/0267758 | A1* | 11/2006 | Barth et al. | 340/539.1 |
| 2007/0115110 | A1* | 5/2007 | Ito et al. | 340/506 |
| 2007/0139183 | A1* | 6/2007 | Kates | 340/521 |
| 2007/0241875 | A1* | 10/2007 | Costa | 340/501 |
| 2008/0117029 | A1* | 5/2008 | Dohrmann et al. | 340/286.02 |
| 2010/0271217 | A1* | 10/2010 | Kates | 340/604 |
| 2011/0241877 | A1* | 10/2011 | Wedig et al. | 340/540 |
| 2012/0293334 | A1* | 11/2012 | Yu et al. | 340/632 |

FOREIGN PATENT DOCUMENTS

| | | |
|---|---|---|
| CN | 101719299 | 6/2010 |
| JP | 10063965 | 3/1998 |

* cited by examiner

SYSTEM AND METHOD FOR WARNING A FIRE AND FLAMMABLE GAS

CROSS-REFERENCE TO RELATED APPLICATIONS

This application is the National Stage of International Application No. PCT/CN2010/000900, filed on Jun. 21, 2010, which claims the priority of Chinese Application No. 200910237391.8, filed on Nov. 10, 2009. The contents of both applications are hereby incorporated by reference in their entirety.

FIELD OF THE INVENTION

System and method for warning a fire and flammable gas is an intelligent warning device with fire and flammable gas pre-warning function.

DESCRIPTION OF THE RELATED ART

Nowadays fire and flammable gas measure and warning system normally consists of detectors and central warning controlling device. Central warning controlling devices collect state signals through bus collecting detectors and distributed collecting detectors, judging the real-time state signals, warning and showing the measurement result.

Detectors transform the physical signals that are detected (such as smoke, temperature, flammable gas consistency, etc.) to electric signals. The art relates to method for warning is known as threshold value warning, which is considered as normal as long as tested signal value is below threshold value. It alarms only if tested signal value is above threshold value which is pre-set. Normally, the range of a physical target value from background value to alarm threshold value is wide. Traditional measuring-warning system considers the value that below threshold value is normal. However, system has been off-normal when tested signal value is higher than background value. For example, latent defect have existed when valves and joints of fuel gas system have trace leakage; smoke signal value and temperature signal value change deviantly, etc. Central warning system does not alarm because it does not reach warning threshold value, which cause that staff on duty probably miss the best opportunity to fix as it is hard to notice the risk. As a result, accident will not be prevented in the initial period. Normally system warning sensitivity will be raised by present technology if we want to discover the risk on time. However, many interfering signals will be considered as warning signals by the system, which causes false alarm. Real warning signal could be ignored as staff on duty will fatigue under frequent false alarm. In addition, warning threshold value settings of some products are limited by strict technical conditions. Specific factory lab condition, even an authentication of a technology supervisory organ for the products are essential. Therefore, raising the sensitivity can not be used extensively.

Electric system which composes the measuring-warning system is ageing easily as it is in long run and the parameter will change as well. With Time Variation, out-put background value and original background value will change depends on the different location that electric measuring-warning system installed, as well as out-put of sensor elements of measuring-warning system. For present fire and flammable gas warning system, products are considered operating normally as long as alarm is not triggered once it is in operation and lack of maintenance. Moreover, whether the product need maintenance or replacement is decided based on preventive overhaul and calibration manually, which means products will be checked annually or after a specific time with technical equipments or in technical factories to be decided if they should be in use continuously. However, time and labor consumption is huge for constructions which are tens or hundreds of thousands sq m if it is done in this way. Products are checked after operating for a certain time, certain percentage of those is several even tens times higher than warning threshold value without warning based on technical checked data. False alarm would happen because present warning system only collect current state value of detectors, judge if alarm should be activated instead of in combination with history operation data of detectors. Plus detectors operating normally or not will not be judged, which cause threshold value of physical signals in the monitor zone will not be discovered when they are higher than dangerous value.

As mentioned above, the present technology has three defects: 1. Targets under monitor have been slightly deviant but is not easily discovered when detector signals are higher than background value and lower than warning threshold value. 2. System decided that whether alarm should be activated based on current value but not based on history data of detectors. 3. System can not judge if detectors are working normally, if their out-put value reliable and if they need maintenance.

SUMMARY OF THE INVENTION

This invention is directed to an intelligent fire and flammable gas warning system and method with pre-warning function, detector self-diagnostic function and warning threshold value self-regulation function.

To achieve the purport mentioned above, fire and flammable gas warning system and method provided by the present invention includes:

Signal detector, installed in the monitored zone for detecting smoke, temperature and flammable gas signal, and then transmitting the signals to warning controller, Warning controller, collecting the smoke, temperature and flammable gas signals from the signal detector in real-time, and then transmits detector data to data manager, Data manager, recording and memorizing background value in original-operation and detected data during operation of the detector, plus data manager real-time analyzes history data during operation of the detector for pre-warning, detector self-diagnosis and warning threshold value self-regulation, and then out-puts analysis result to pre-warning monitor, Pre-warning monitor, showing pre-warning analyses result from the data manager.

The feature of warning system mentioned above is characterized in that the data manager further includes:

System set-up module, setting up address and type of the signal detector,

Memory module, recording and memorizing background value in original-operation and data during operation of the detector, Monitor managing module, monitoring and analyzing data in real time during operation of the detector, then out-putting advanced pre-warning message, detector self-diagnosis message and warning threshold value self-regulation message to pre-warning monitor.

The feature of warning system mentioned above is the monitor managing module further includes:

Advanced pre-warning unit, a unit analyzing operation data of each detector. Pre-warning massage will be sent in advance when current operation data of the detector duration pre-set time is higher than background value and lower than warning threshold value.

Detector self-diagnostic unit, a unit real-time analyzes the background value change of detector by analyzing history operation data in combination with original-operation data of each detector. System will send pre-warning message and cues that detector need to be maintained or checked.

Warning threshold value self-regulation unit, a unit real-time analyzes background value change of detectors by analyzing history data in combination with original-operation data of each detector, then self-regulating warning threshold value incorporate with background value change when the change is in a rational range.

The feature of warning system mentioned above is the monitor managing module includes: detector operation trend chart generation unit, for data manager inquiring history operation data of the detector when there is an alarm in the system, and then generating a operation trend history curve diagram of the detector based on the data.

The feature of pre-warning system mentioned above is the signal detectors include: fire signal detector and/or flammable gas signal detector. In addition, the fire signal detectors are smoke sensitive detector, temperature sensitive detector or temperature-smoke sensitive detector; the flammable gas signal detectors are methane detector, propane detector or CO detector.

The feature of pre-warning system mentioned above is the pre-warning controller includes fire warning controller and/or flammable gas warning controller.

The feature of pre-warning system mentioned above is the pre-warning controller real-time collects fire signal or flammable gas signal in monitor zone by bus-communication or distributed-communication.

Furthermore, this invention offers a method of fire and flammable gas warning for signal detector, warning controller, data manager and pre-warning monitor, the method is:

Procedure signal detecting, detecting smoke, temperature and flammable gas signal by the signal detector, and then transmit the signal to the warning controller.

Procedure pre-warning controlling, real-time collects the smoke, temperature or flammable gas signal by the warning controller, and then transmit detecting data to the data manager.

Procedure data managing, records and memorizes background value of the detector in original-operation and detecting data during operation of the detector, real-time analyzes history data during operation of the detector for pre-warning in advance, detector self-diagnostic and warning threshold value self-regulation, and then out-puts analyzing result to the pre-warning monitor.

Procedure pre-warning monitoring, shows the pre-warning analyzing result form the data manager by a monitor.

The feature of pre-warning method mentioned above is procedure data managing further includes:

Step system setting, setting up address and type of each detector.

Step memorizing, recording and memorizing background values in original-operation and detecting data during operation of all detectors.

Step monitoring and managing, real-time monitoring and analyzing detecting data of the detector during operation, out-putting advanced pre-warning massage, detector self-diagnostic massage and warning threshold value self-regulation massage to pre-warning monitor.

The feature of pre-warning method mentioned above is step 3, monitoring and managing includes:

Step pre-warning in advance, analyzing operation data of each detector, sending advanced pre-warning massage when current operation data duration pre-set time quantum is higher than background value but lower than warning threshold value.

Step detector self-diagnostic, real-time analyzing background value change of each detector by analyzing history operation data in combination with detecting data in original-operation of the detector, sending pre-warning massage when current background value of the detector in the pre-set time quantum is deviant long time compare with the original-operation background value which is recorded in the system, and then cuing that detectors need to be maintained and checked.

Step warning threshold value self-regulation, real-time analyzing background change of detector by analyzing history data in combination with original-operation data of the detector, warning threshold value self-regulating automatically incorporating with background value change when the change is in a rational range.

The feature of warning method mentioned above is monitoring and managing includes: Detector operation trend chart generation. When there is an alarm in the warning system, data manager inquires history data of the warning detector, and then generates an operation trend history curve diagram of the detector based on this data.

The feature of pre-warning method mentioned above is the signal detectors include fire signal detector and/or flammable gas signal detector. In addition, the fire signal detectors are smoke sensitive detector, temperature sensitive detector or temperature-smoke sensitive detector; the flammable gas signal detectors are methane detector, propane detector or CO detector.

The feature of pre-warning method mentioned above is the pre-warning controllers include fire pre-warning controller and/or flammable gas pre-warning controller.

The feature of pre-warning method mentioned above is that in procedure 2, pre-warning controlling, the pre-warning controller real-time collecting fire signal or flammable gas signal by bus-communication and distributed-communication.

Compare to current technology, the present invention has its own advantages, for example:

1. Real-time monitor detectors, sending pre-warning signal for detectors before its operation data changes deviantly but not up to warning threshold vale, which implements pre-warning cuing in advance, advances security defense, improves system assurance factor by preventing accidents in the first place.

2. Capable of storing all the detecting signals for years by using strong ability of data processing of CPU. When accidents happen, it could supply data for incident analyzing, responsibility analyzing, and project issue judging.

3. Capable of judging operating situation of detectors by long-term monitoring out-put signal of detectors continually. Such as, whether they need maintenance, replacement or keep running. By this it could reduce labor and raise service and reduce trouble of checking manually.

4. Showing history curve diagram of the warning address which could be a reference used by monitor staff when there is detector warning, which could raise warning reliability.

DETAILED DESCRIPTION OF THE PREFERRED EMBODIMENTS

Figure 1:
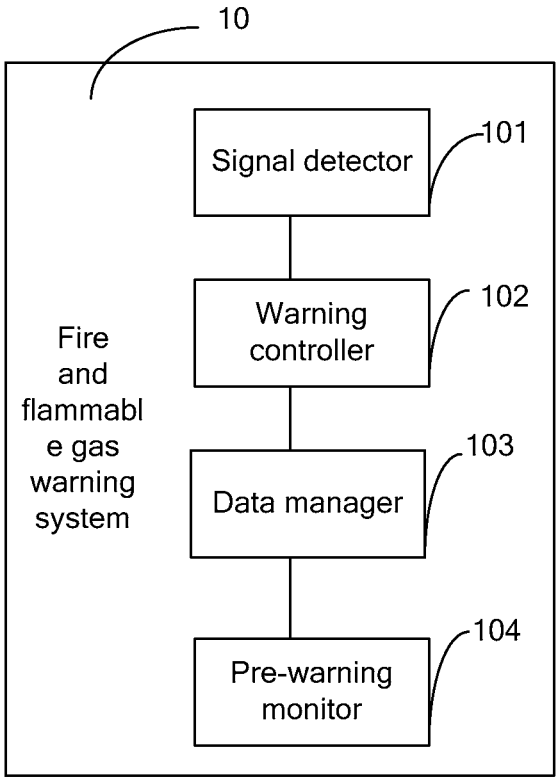
FIG. 1 is a constructional diagram showing a fire and flammable gas warning system of the present invention.

Reference will now be made in detail to the present preferred embodiment of the invention as illustrated in the accompanying drawings for the purpose, plans and efficacy of the present invention to be further understood FIG. 1 shows a constructional diagram of a fire and flammable gas pre-warning system 10 of the present invention, which includes signal detector 101, warning controller 102, data manager 103 and pre-warning monitor 104. In addition, signal detector which is in use for detecting smoke signal, temperature signal, or flammable gas signal and transmits the signal to warning controller 102 is installed in the monitor zone and connects with warning controller 102. Warning controller 102 which is in use for real-time collecting smoke signal, temperature signal or flammable gas signal detected by the detector and transmitting detecting data to data manager 103 connects with data manager 103. Data manager 103 which is in use for recording and storing background value in original-operation and detecting data during operation of all the detectors, and then real-time analyzing history data during operation of each detector for pre-warning, detector self-diagnostic or warning threshold value self-regulation, and then out-putting analysis result to pre-warning monitor 104 connects with pre-warning monitor 104. Pre-warning monitor 104 is in use for receiving pre-warning analysis result from data manager and showing real-time monitoring pre-warning massage on the monitor.

Figure 2:
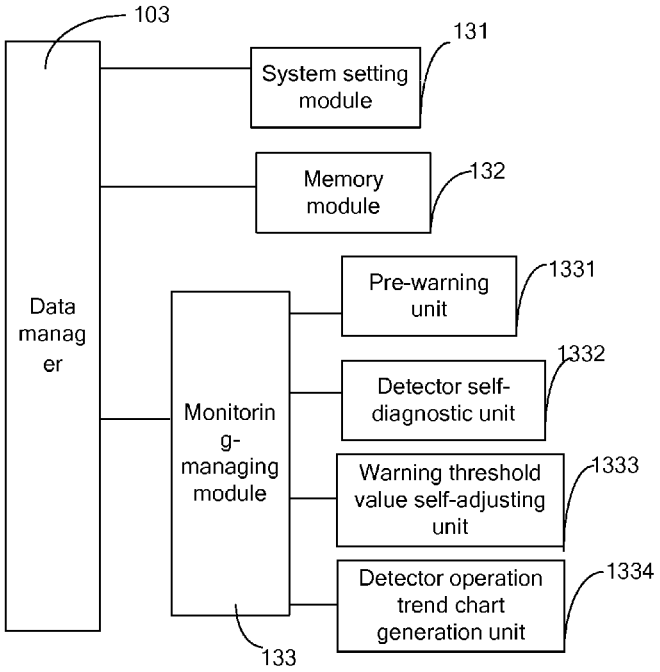
FIG. 2 is a main constructional diagram showing data manager in the warning system of the present invention.

FIG. 2, the data manager 103 mentioned above includes: system setting module 131 which is in use for setting address and type of each detector; memory module 132 which is in use for recording and memorizing background value in original-operation and detecting data during operation of all the detectors; monitoring-managing module 133 which is in use for real-monitoring, analyzing and manipulating detecting data during operation, and out-putting pre-warning massage in advance, detector self-diagnostic massage or warning threshold value self-regulation massage to pre-warning monitor. The monitoring-managing module further includes: advanced pre-warning unit 1331 which is in use for analyzing operation data of each detector. When current operation data duration pre-set time quantum is higher than background value but lower than warning threshold value, this unit will send pre-warning massage in advance. Detector self-diagnostic unit 1332 which is in use for real-time analyzing the background value change of detector by analyzing history operation data in combination with original-operation data of each detector. Pre-warning unit 1331 will send pre-warning message and cues that detector need to be maintained or checked when duration pre-set time quantum of current background value of the detector is more than as twice high as system background value in original-operation. Warning threshold value self-regulation module 1333 is in use for real-time analyzing background value change of detectors by analyzing history data in combination with original-operation data of each detector, and then self-regulating warning threshold value incorporate with background value change. Detector operation trend chart generation module 1334 which is in use for data manager inquiring history operation data of the detector when there is an alarm in the system, and then generating an operation trend history curve diagram of the detector based on the data. This curve diagram is a reference for monitor staff to reduce system false alarm.

Figure 3:
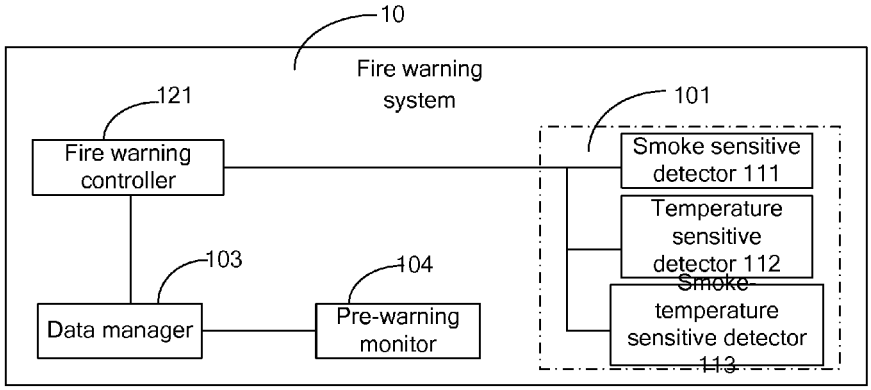
FIG. 3 is a constructional diagram showing preferred embodiment No. 1 in the warning system of the present invention.

FIG. 3 is a constructional diagram showing preferred embodiment No. 1 in the warning system of the present invention, which describes a fire warning system by bus-communication. Signal detector 101 includes smoke sensitive detector 111, temperature sensitive detector 112 and smoke-temperature sensitive detector 113. Fire warming controller 121 real-time collects fire signal in the monitoring zone by bus-communication, and then transmits the detecting data to data manager.

Figure 4:
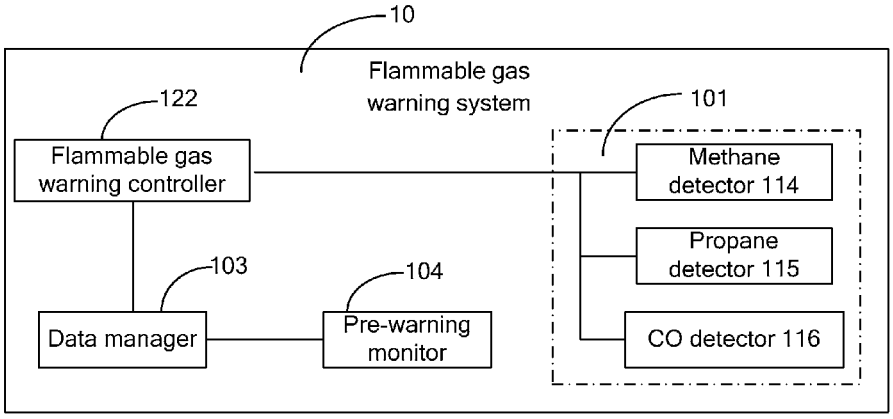
FIG. 4 is a constructional diagram showing preferred embodiment No. 2 in the warning system of the present invention.

FIG. 4 is a constructional diagram showing preferred embodiment No. 2 in the warning system of the present invention, which describes a flammable gas warning system by bus-communication. Signal detector 101 includes methane detector 114, propane detector 115 and CO detector 116. Flammable gas warming controller 122 real-time collects fire signal in the monitoring zone by bus-communication, and then transmits the detecting data to data manager.

Figure 5:
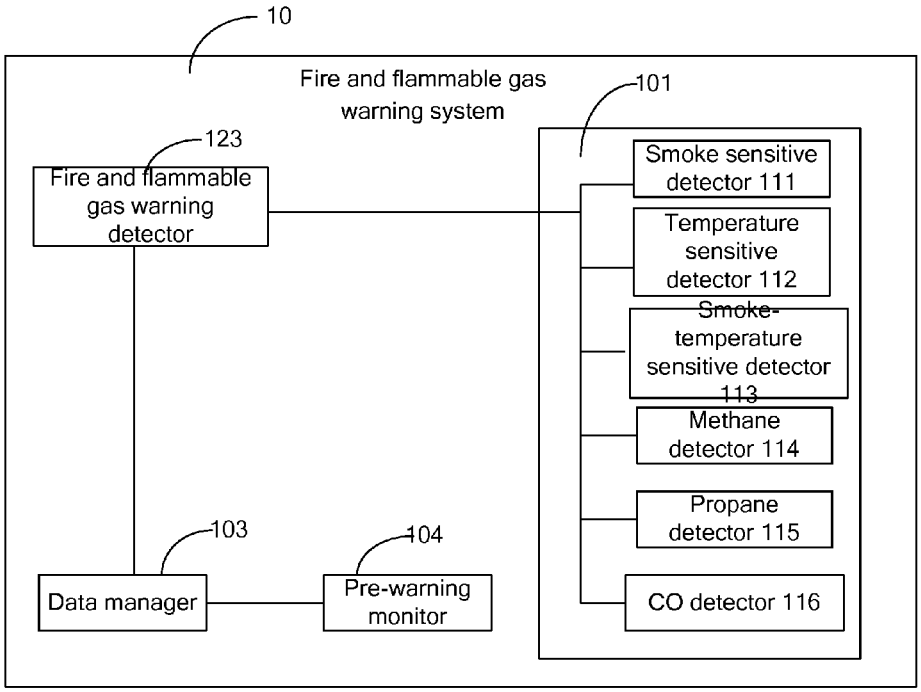
FIG. 5 is a constructional diagram showing preferred embodiment No. 3 in the warning system of the present invention.

FIG. 5 is a constructional diagram showing preferred embodiment No. 3 in the warning system of the present invention, which describes a fire or flammable gas warning systems by bus-communication. Signal detector 101 includes smoke sensitive detector 111, temperature sensitive detector 112, smoke-temperature sensitive detector 113, methane detector 114, propane detector 115 and CO detector 116. Warning controller 123 real-time collects fire signal in the monitoring zone by bus-communication, and then transmits the detecting data to data manager.

Figure 6:
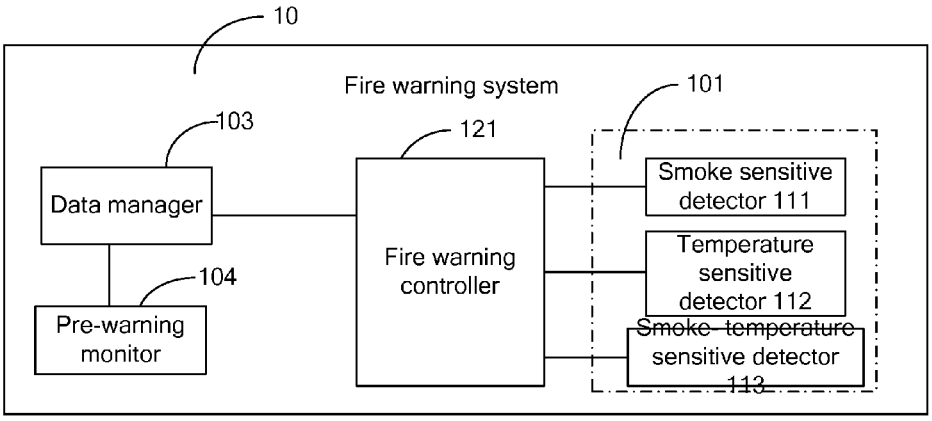
FIG. 6 is a constructional diagram showing preferred embodiment No. 4 in the warning system of the present invention.

FIG. 6 is a constructional diagram showing preferred embodiment No. 4 in the warning system of the present invention, which describes a fire warning system by distributed-communication. Signal detector 101 includes smoke sensitive detector 111, temperature sensitive detector 112 and smoke-temperature sensitive detector 113. Fire warning controller 121 real-time collects fire signal in the monitoring zone by distributed-communication, and then transmits the detecting data to data manager.

Figure 7:
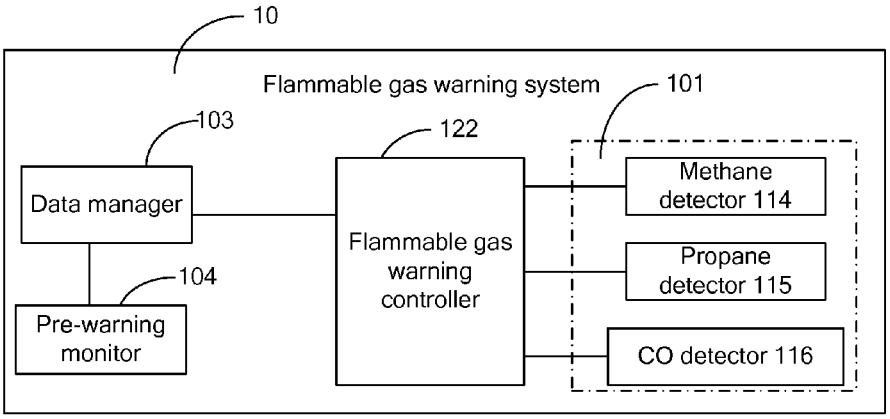
FIG. 7 is a constructional diagram showing preferred embodiment No. 5 in the warning system of the present invention.

FIG. 7 is a constructional diagram showing preferred embodiment No. 5 in the warning system of the present invention, which describes a flammable gas warning system by distributed-communication. Signal detector 101 includes methane detector 114, propane detector 115 and CO detector 116. Flammable gas warning controller 122 real-time collects fire signal in the monitoring zone by distributed-communication, and then transmits the detecting data to data manager.

Figure 8:
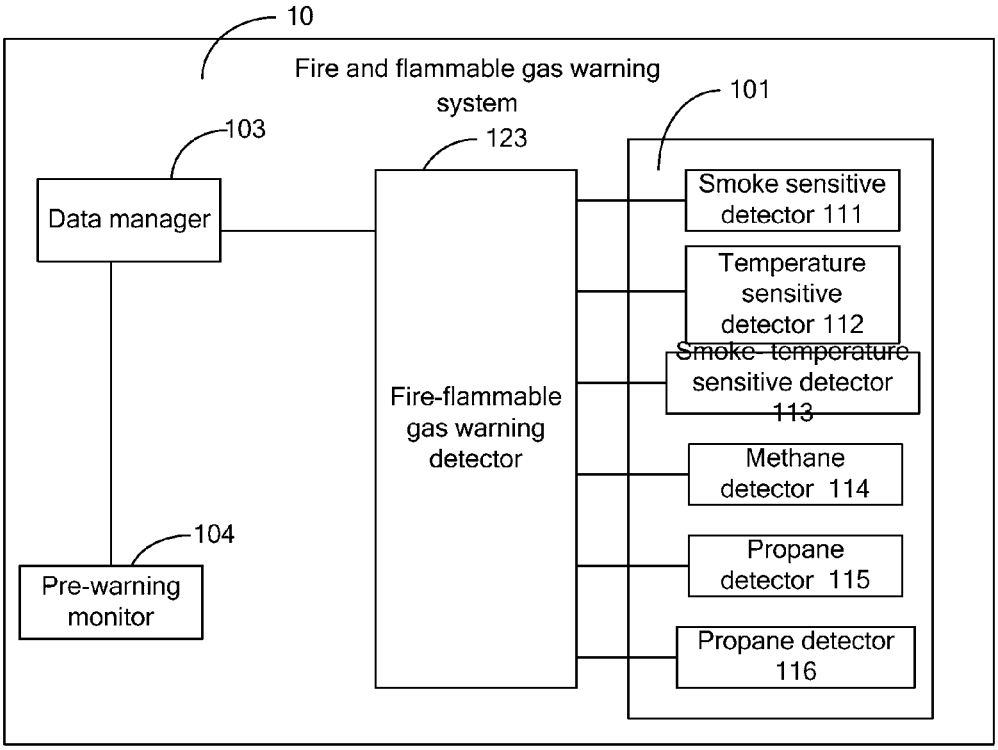
FIG. 8 is a constructional diagram showing preferred embodiment No. 6 in the warning system of the present invention.

FIG. 8 is a constructional diagram showing preferred embodiment No. 6 in the warning system of the present invention, which describes a fire or flammable gas warning system by distributed-communication. Signal detector 101 includes smoke sensitive detector 111, temperature sensitive detector 112, smoke-temperature sensitive detector 113, methane detector 114, propane detector 115 and CO detector 116. Warning controller 123 real-time collects fire signal in the monitoring zone by distributed-communication, and then transmits the detecting data to data manager.

Figure 9:
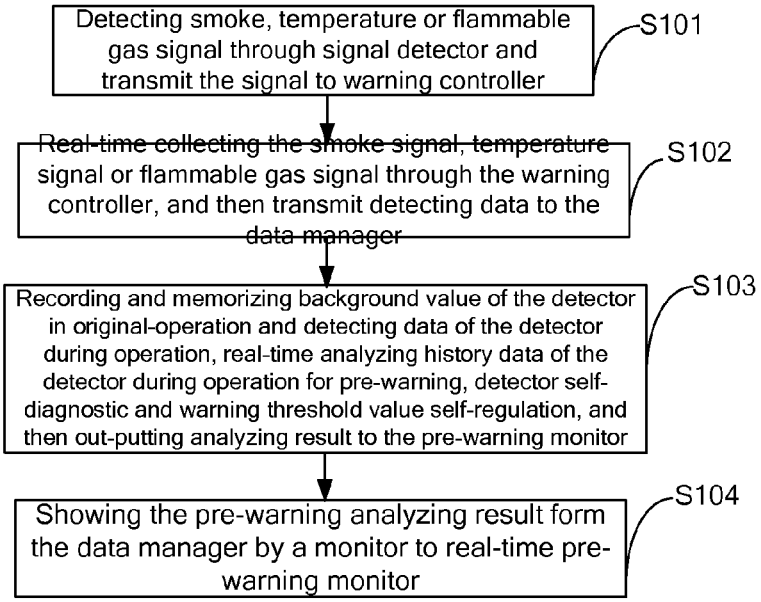
FIG. 9 is a flow process diagram showing a fire and flammable gas warning method of the present invention.

The present invention offers a fire or flammable gas warning system that could be used in the warning system mentioned above. FIG. 9 is a flow process diagram showing a fire and flammable gas warning method of the present invention. According to FIG. 9 the fire and flammable gas pre-warning method of the present invention is used for the pre-warning system which includes signal detector, warning controller, data manager and pre-warning monitor. The method is:

Step S101, sing detecting, which is for detecting smoke, temperature or flammable gas signal through signal detector and transmit the signal to warning controller. Signal detectors are smoke signal detector and/or flammable gas signal detectors. Fire signal detectors could be smoke sensitive detector, temperature sensitive detector and/or temperature-smoke sensitive detector. Flammable gas signal detectors could be methane detector, propane detector and/or CO detector.

Step S102, pre-warning controlling, which is for real-time collecting the smoke signal, temperature signal or flammable gas signal through the warning controller, and then transmit detecting data to the data manager. Warning controller includes fire warning controller and/or flammable gas warning controller.

Step S103, data managing, which is for recording and memorizing background value of the detector in original-operation and detecting data of the detector during operation, real-time analyzing history data of the detector during operation for pre-warning in advance, detector self-diagnostic and warning threshold value self-regulation, and then out-putting analyzing result to the pre-warning monitor.

Step S104, pre-warning monitoring, which is for showing the pre-warning analyzing result form the data manager by a monitor to real-time pre-warning monitor.

Figure 10:
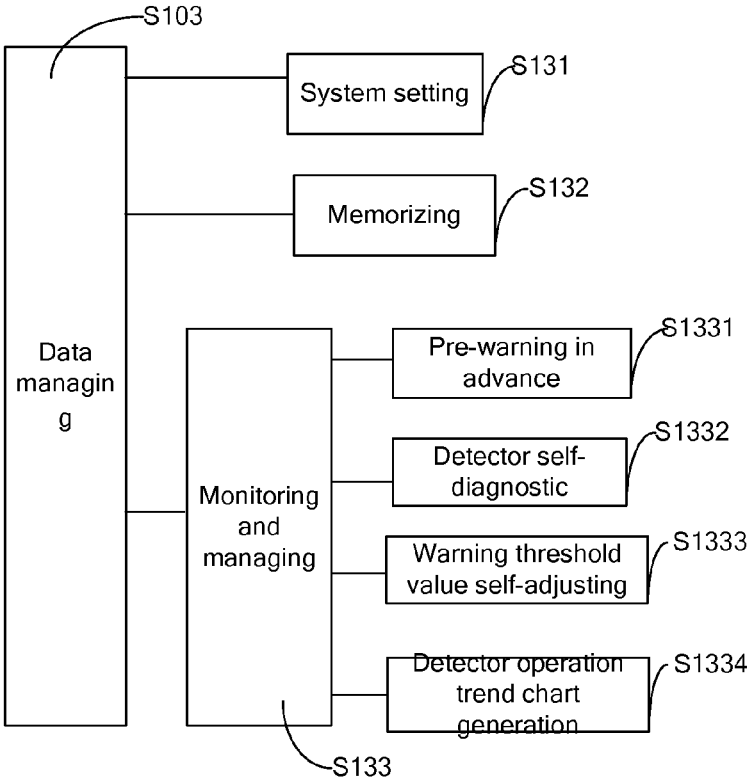
FIG. 10 is a detail flow process showing steps in data managing in warning method of the present invention.

According to FIG. 10, step S103 mentioned above further includes following steps:

System setting S131, setting up address and type of each detector.

Memorizing S132, recording and memorizing background values in original-operation and detecting data during operation of all detectors.

Monitoring and managing, Step 33, real-time monitoring and analyzing detecting data of the detector during operation, out-putting pre-warning massage, detector self-diagnostic massage and warning threshold value self-regulation massage to pre-warning monitor.

Monitoring and managing, Step 133 mentioned above further includes:

Pre-warning in advance, S1331, analyzing operation data of each detector and sending pre-warning massage in advance when current operation data duration pre-set time quantum is higher than background value but lower than warning threshold value. Detector self-diagnostic, S1332, real-time analyzing background value change of each detector by analyzing history operation data in combination with detecting data in original-operation of the detector, sending pre-warning massage when current background value of the detector in the pre-set time quantum is deviant long time compare with the original-operation background value which is recorded in the system, and then cuing that detectors need to be maintained and checked.

Warning threshold value self-regulation, S1333, real-time analyzing background change of detector by analyzing history data in combination with original-operation data of the detector, warning threshold value self-regulating automatically incorporating with background value change when the change is in a rational range.

Detector operation trend chart generation, S1334, which is in use for data manager inquiring history operation data of the detector when there is an alarm in the system, and then generating an operation trend history curve diagram of the detector based on the data. This curve diagram is a reference for monitor staff to reduce system false alarm.

Further details in preferred embodiments of the present invention will be given in the following part.

The data manager in the present invention could be a PC. Background value of all the detectors in original-operation will be recorded through the PC. With strong memory ability of PC, operation data and operation state of each detector will be recorded for years till the detector is replaced. PC real-time analyzes history data of each detector in combination with background value in original-operation of the detector by manage-monitor software that is installed in data manager. PC will find address whose value is higher than background value but lower than warning threshold value and it will cue when the address is considered deviant as well as real-time analyze history data in combination with background value of each detector which is recorded. Finding background value change of each detector, warning threshold value self-regulation will also be done by PC. Pre-warning will be cued, detector needs to be maintained and checked when background value of detector changes deviantly.

The background value mentioned here is average value of current data in a time quantum that product is in operation. It can obviate more than 50% data in the warning threshold value. The average value shows the drift state of reference point of products. Or it can be understood as the drift of reference as the average value is an adaptation to the current environment. Electronic products must have drift issue, so that the history data of whose need manipulation to get a relative-accurate current reference. However, to the present invention, not all the history data in the time quantum is going into data manipulation. They need to be screened. Details in manipulation are: For example, 1 current data could be had every 1 minute for those addresses monitored in the system. There will be 1440 data in 24 hours. The monitor-managing software installed in the data manager implements the arithmetic below in a fixed time everyday. The arithmetic is renewing current background value once every 24 hours. Obviating data which is 50% higher than warning threshold value and ordering the left data in descending. Then getting current day background value by averaging ⅓ data in the middle of those ordered data. Getting current background value after that by averaging current day background value of ten days backwards.

System calculates current data of all the addresses every minute by the arithmetic followed. When it calculates every time, averaging 10 data in the middle out of the 16 data backwards which are ordered, then getting current data by manipulation.

Monitoring-managing software will give pre-warning cue when current data is 130% and 10 consecutive times higher than current background value and lower than warning threshold vale. System will do a judgment and comparison every time when there is a current data, which means system will renew result every minute.

Monitoring-managing software will give pre-warning cue when current background value is 200% and 10 consecutive times higher background value in original-operation. And cuing detectors need to be maintained and or checked.

Figure 11:
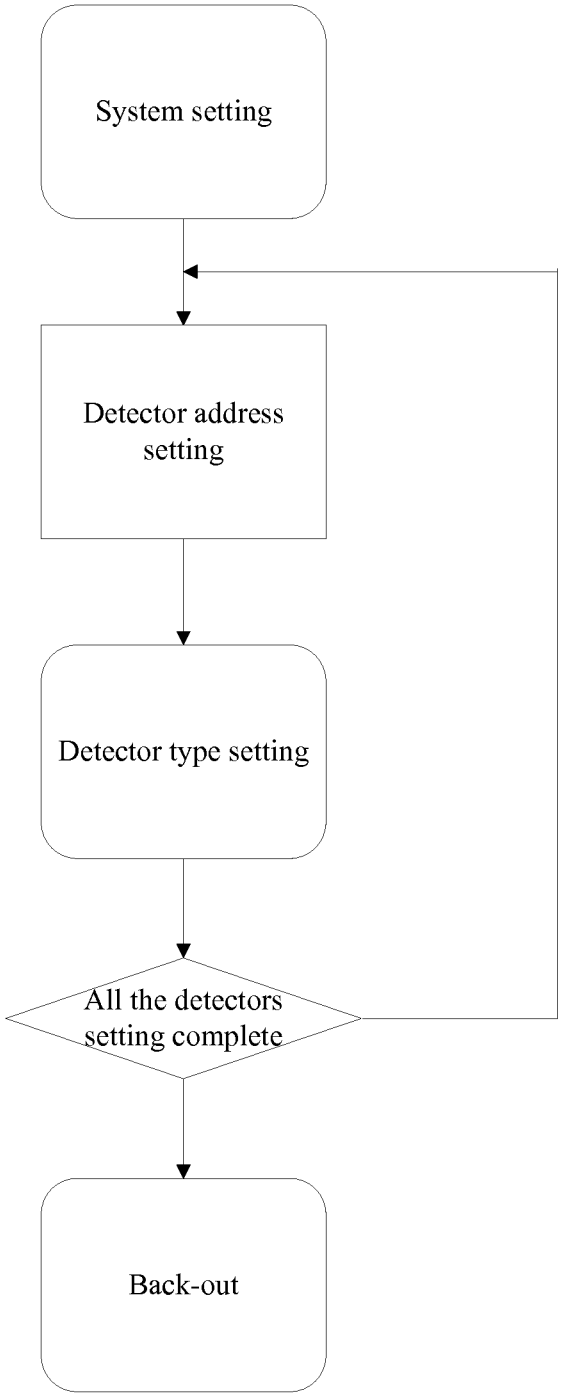
FIG. 11 is a setting flow process in data managing software in warning system of the present invention.
Figure 12:
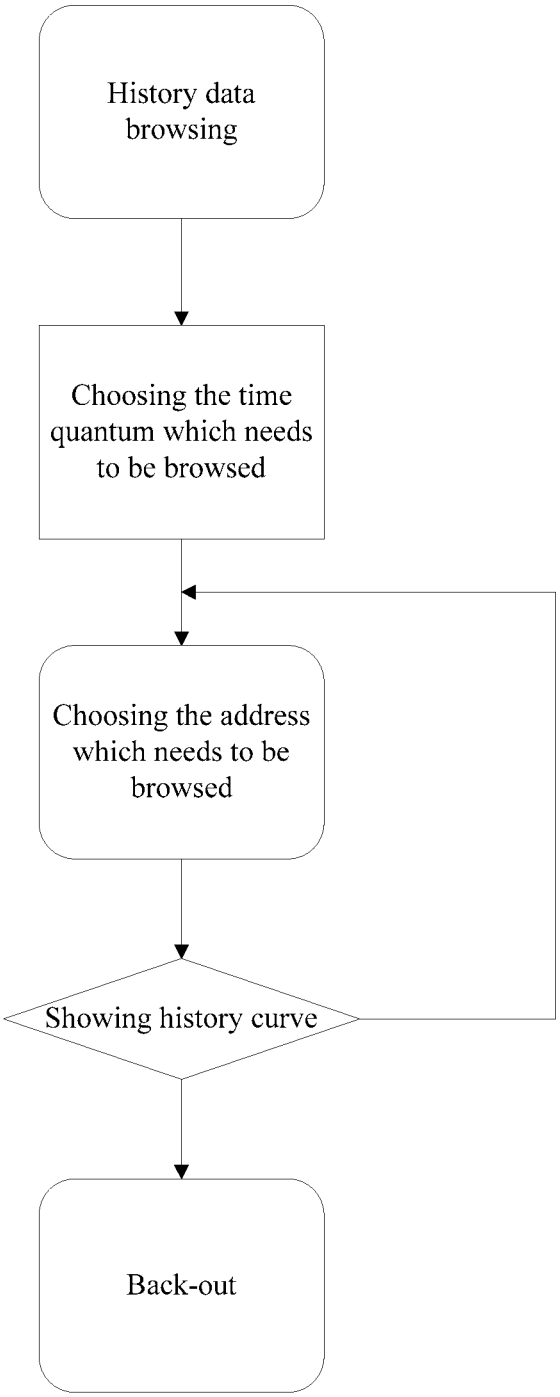
FIG. 12 is a history data browsing flow process in data managing software in warning system of the present invention.

FIG. 11 and FIG. 12 show job processes in the present invention. Firstly, setting up system: setting up address and type of detectors for understanding those detectors. The setting up processes is showed in FIG. 11. History can be browsed at any time during monitor in operation: More than one detector could be selected to compare their operation data in the same time quantum. Using processes is showed in FIG. 12.

After the present invention is started into monitor, the system software will communicate with fire or flammable gas warning controller and request report for current configuration of controllers, such as how many monitor addresses, type of each address and the operation data from the product in these addresses. Then monitor staff will be cued to check and confirmed if there is a difference between those operation data and the data from inside of system. System monitors those addresses that have the same configuration. Reading data issue will be activated by timer which is set by 1 minute, and then reading and storing data of all the addresses those are monitored. Current data analyzing issues will be activated after that.

Current data analyzing issues: averaging 10 data in the middle out of the 16 data backwards which are ordered, and then getting current data by manipulation. Monitoring-managing software will give pre-warning cue when current data is 130% and 10 consecutive times higher than current background value and lower than warning threshold vale.

Manipulation of current background value: activating the issues according to implement time (once every 24 hours) set by managing software. In 60*24=1440 data of the current day, obviating the data which is 50% higher than warning threshold value and ordering the left data in descending. Then getting current day background value by averaging ⅓ data in the middle of those ordered data. Getting current background value after that by averaging current day background value of ten days backwards. Monitoring-managing software will give pre-warning cue when current background value is 200% and 10 consecutive times higher background value in original-operation. And cuing detectors need to be maintained and or checked.

The present invention is not limited by time and times mentioned in this article. The time, times and other data mentioned here could be changed by system software according to monitor request.

The present invention has given a preferred embodiment as above. However, the sample does not limit the present invention. Variety of the present by technicist who is familiar with this field is available as long as not against the spirit and essentiality of the present invention. However, these diverse changes should be all in the range of the present invention's claim.

INDUSTRY UTILITY

Fire and flammable gas warning system and method which use the present invention send pre-warning signal in advance with CPU's strong ability of data processing by long-term consecutively monitoring out-put signal of detector for those detectors whose operation data changes deviantly when is not up to warning threshold value, which achieves pre-warning cue in advance. Security defense is advanced to prevent accidents in the first place. Detector history data could be also combined to comprehensively judge if alarm should be activated. Plus, whether detectors are working normally, whether out-put value is reliable and whether it needs maintenance could be detector self-diagnosticed, which can improve system assurance factor.

What is claimed is:

1. A fire and flammable gas pre-warning system, comprising:

a signal detector installed in a monitor zone for detecting smoke, temperature, or flammable gas signals, and then transmitting the signals to a warning controller, a warning controller for collecting in real time the smoke, temperature, or flammable gas signals from the signal detector and transmitting the signal detector data to a data manager, a data manager, and a pre-warning monitor for showing pre-warning analyses result from the data manager, wherein the data manager includes a system set-up module for setting up address and type of the signal detector, a memory module for recording and memorizing a background value in original operation and data during operation of the signal detector, and a monitor managing module for monitoring in real time data from the signal detector during operation and outputting pre-warning messages in advance, signal detector self-diagnostic messages, and warning threshold value self-regulation messages to the pre-warning monitor, the monitor managing module including an advanced pre-warning unit for analyzing operation data of each signal detector, generating in advance the pre-warning messages when current operation data of the signal detector duration pre-set time is higher than a current background value and lower than a warning threshold value.

2. The pre-warning system of claim 1, wherein the monitor managing module further includes:

a detector self-diagnostic unit for analyzing the background value change of the signal detector by analyzing history operation data in combination with original-operation data of each signal detector and sending pre-warning message and cues that the signal detector needs to be maintained or checked.

3. The pre-warning system of claim 2, wherein the monitor managing module further includes a detector operation trend chart generation unit for data manager inquiring history operation data of the signal detector when there is an alarm in the system, and then generating an operation trend history curve diagram of the signal detector based on the data.

4. The pre-warning system of claim 1, wherein the signal detector includes a fire signal detector and/or a flammable gas signal detector, the fire signal detector is a smoke sensitive detector, a temperature sensitive detector, or a temperature-smoke sensitive detector, and the flammable gas signal detector is a methane detector, a propane detector, or a CO detector.

5. The pre-warning system of claim 1, wherein the warning controller includes a fire warning controller and/or a flammable gas warning controller.

6. The pre-warning system of claim 1, wherein the warning controller collects in real time the fire signal or the flammable gas signal in the monitor zone by bus-communication or distributed-communication.

7. A fire and flammable gas pre-warning method utilizing a signal detector, a warning controller, a data manager, and a pre-warning monitor, the method comprising:

the signal detector detecting smoke, temperature, or flammable gas signal in a monitor zone and then transmitting the signal to the warning controller, the warning controller collecting in real time the smoke signal, temperature signal, or flammable gas signal and then transmitting detecting data to the data manager, the data manager setting up address and type of each signal detector, recording and memorizing background value of the signal detector in original-operation and detecting data of the signal detector during operation, real-time monitoring and analyzing history data of the signal detector during operation for advanced pre-warning, detector self-diagnostic, and warning threshold value self-regulation, and then out-putting pre-warning message, detector self-diagnostic message, and warning threshold value self-regulation message to the pre-warning monitor, and the pre-warning monitor showing the output from the data manager via a monitor.

8. The pre-warning method of claim 7, wherein the recording and memorizing background value of the signal detector in original-operation and detecting data of the signal detector during operation is accomplished by:

analyzing operation data of each signal detector, sending pre-warning message in advance when current operation data duration pre-set time quantum of the signal detector is higher than a current background value but lower than a warning threshold value, real-time analyzing background value change of each signal detector by analyzing history operation data in combination with detecting data in original-operation of the signal detector, sending pre-warning message when the current background value of the signal detector in the pre-set time quantum is deviant long time compared to the original-operation background value which is recorded in the system, and then cuing the signal detectors need to be maintained and checked, and analyzing in real time background change of each signal detector by analyzing history data in combination with original-operation data of the signal detector, warning threshold value self-regulating automatically incorporating with background value change when the change is in a rational range.

9. The pre-warning method of claim 8, further comprising generating a signal detector operation trend chart, wherein when there is an alarm in the warning system, the data manager inquires history data of the warning detector, and then generates an operation trend history curve diagram of the signal detector based on this data.

10. The pre-warning method of claim 7, wherein the signal detector includes a fire signal detector and/or a flammable gas signal detector, the fire signal detectors are smoke sensitive detector, temperature sensitive detector, or smoke-temperature sensitive detector, and the flammable gas detectors are methane detector, propane detector, or CO detector.

11. The pre-warning method of claim 7, wherein the warning controller includes a fire warning controller and/or a flammable gas warning controller.

12. The pre-warning method of claim 7, wherein the warning controller collects in real time fire signal or flammable gas signal in the monitor zone by bus-communication or distributed-communication.

13. The pre-warning system of claim 2, wherein the monitor managing module further includes a warning threshold value self-regulation unit for analyzing in real time background value change of signal detectors by analyzing history data in combination with original-operation data of each signal detector and self-regulating the warning threshold value incorporate with background value change when the change is in a rational range.

* * * * *